United States Patent [19]

Allen

[11] Patent Number: 4,528,933

[45] Date of Patent: Jul. 16, 1985

[54] CONTAINER WITH INDICATING CLOSURE

[76] Inventor: Robert Allen, 5005 Brookhaven Ct., Oxon Hill, Md. 20745

[21] Appl. No.: 493,509

[22] Filed: May 11, 1983

[51] Int. Cl.[3] ..... G09F 9/00; G09F 11/04

[52] U.S. Cl. ..... 116/308; 116/312

[58] Field of Search ..... 116/308, 311, 312, 314; 215/223; 206/534

[56] References Cited

U.S. PATENT DOCUMENTS

| | | | |
|---|---|---|---|
| 2,739,564 | 3/1956 | North | 116/308 |
| 3,151,599 | 10/1964 | Livingston | 116/308 |
| 3,557,747 | 1/1971 | Rigney | 206/534 |
| 4,011,829 | 3/1977 | Wachsmann | 116/308 |

FOREIGN PATENT DOCUMENTS

| | | | |
|---|---|---|---|
| 1383865 | 2/1975 | United Kingdom | 215/223 |

*Primary Examiner*—Charles Frankfort
*Assistant Examiner*—Denis E. Corr
*Attorney, Agent, or Firm*—Harvey B. Jacobson; Clarence A. O'Brien

[57] ABSTRACT

A container for pharmaceuticals and the like has a cap-like closure incorporating an indicator disk which is automatically indexed into successive indicating positions each time the container is used by removal and replacement of the closure. The container also has a manually operable rotary reminder wheel on its base. The disk may be used to indicate days of the week and the wheel to indicate hours of the day.

18 Claims, 3 Drawing Figures

FIG. 1
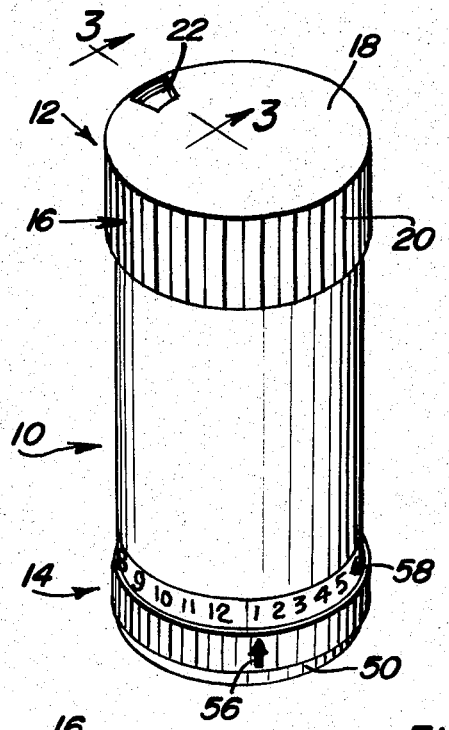
FIG. 3
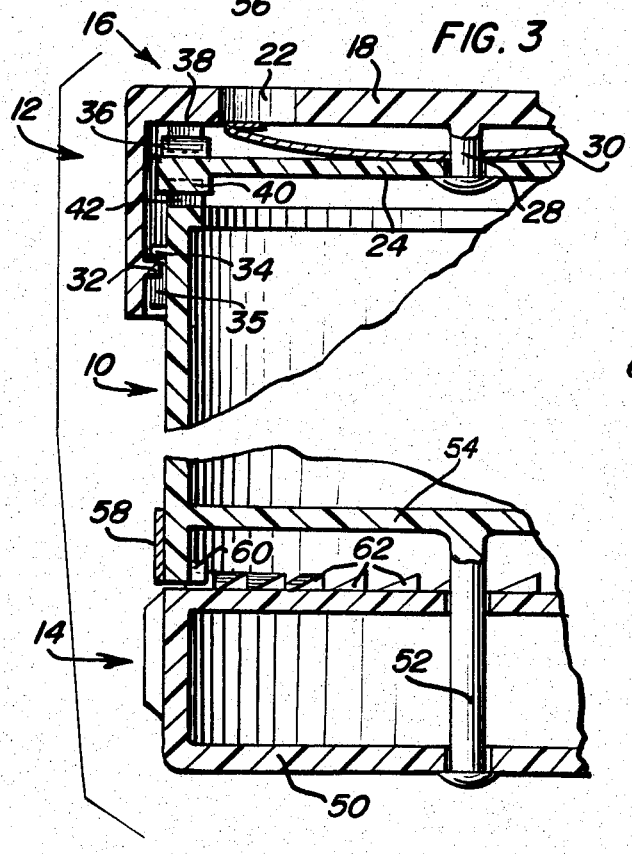
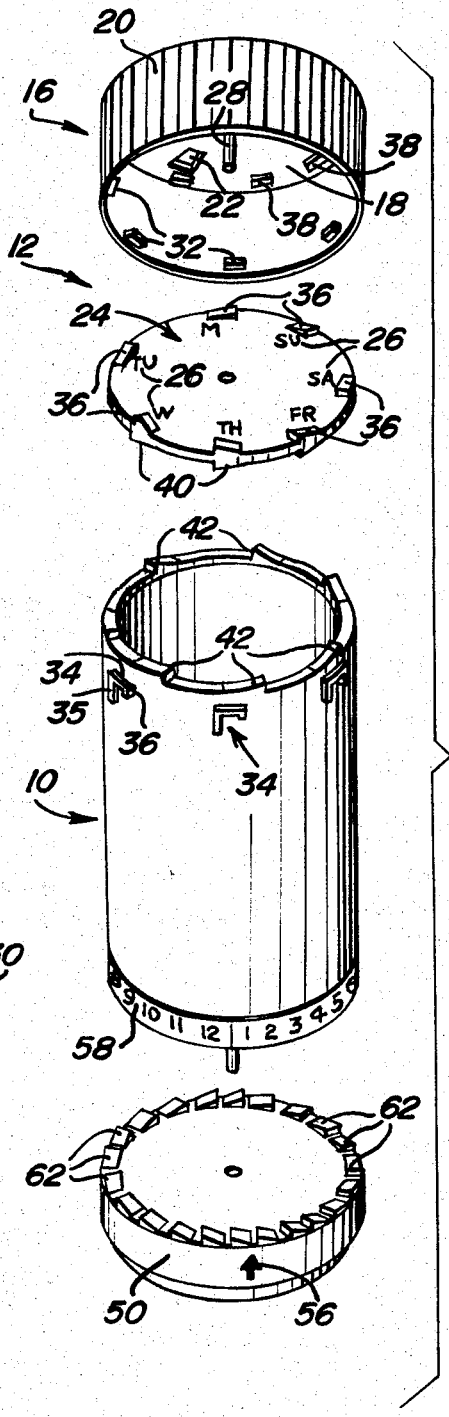
FIG. 2

CONTAINER WITH INDICATING CLOSURE

BACKGROUND OF THE INVENTION

The invention relates to containers with indicating closures. For example, with pharmaceutical containers, it may be desirable for a record to be maintained of how many times a container has been opened, or it may be desirable to provide a reminder to a user of when succeeding doses of medication are to be taken. The invention is concerned with containers having closures capable of indicating such matters.

Statement of Prior Art

Indicating container closures are well known, and applicant is aware of the following U.S. patents showing such containers:.

| | |
|---|---|
| 2,066,183 | Dec. 29, 1936 |
| 2,111,637 | Mar. 22, 1938 |
| 3,151,599 | Oct. 6, 1964 |
| 3,678,884 | July 25, 1972 |
| 3,960,713 | June 1, 1976 |
| 4,011,829 | Mar. 15, 1977 |
| 4,207,982 | June 17, 1980 |

The patents to Livingston and Wachsmann et al, for example, each show containers having closure caps incorporating a rotary indicator disk which is automatically turned to a different indicating position each time the container is opened or closed. The closure structures shown in these Patents, however, tend to be somewhat complex in nature and those in which the caps are removable from their respective containers employ cap assemblies having three mutually rotatable elements.

SUMMARY OF THE INVENTION

The present invention provides a container and removable indicating closure therefor in the form of a cap having two mutually rotatable parts, one of which comprises an indicator disk which is automatically turned to a different indicating position whenever the container is used by removing and replacing the cap.

In a preferred form of the invention, the cap may comprise a body member having a base and a depending skirt with internal projections on the skirt adapted to cooperate with complementary external projections on the container to provide lock fittings whereby the cap may be secured to the container with a non-threaded twist lock action, and be removed from the container by a reverse twisting action. The indicator disk may be rotatably secured internally of the cap in juxtaposition to the cap base, and may have circumferentially disposed indicator marks, one of which is visible at any time through a window in the base of the cap. Indexing means is provided for rotating the disk relative to the body member of the cap by a single rotational increment corresponding to the angle between successive indexing marks each time the container is used (by removing and replacing the cap) so as to bring a succeeding indicator mark into view in the window. The indexing means may, for example, comprise a first set of complementary ratchet teeth formed on the interior of the body member and on one surface of the disk respectively, and a second set of complementary ratchet teeth formed on the other surface of the disk and on the rim of the container respectively. The ratchet teeth are configured and disposed to cause the disk to move with the cap when the cap is twisted on the container in one direction, e.g. when removing the cap, and to move relative to the cap when the cap is twisted on the container in the other direction, e.g. when replacing the cap. Further, the disposition of the teeth and locking projections on the cap and on the container are such as to insure that sufficient twisting of the cap takes place when it is replaced on the container to provide the required rotational increment of the disk.

The invention is believed to provide an automatic indexing and indicating container and closure of relatively simplified construction compared with similar constructions known in the art.

Another aspect of the invention is the provision of a manual reminder device which may be in the form of a rotary wheel, on the base of the container. This device may be used to provide additional information to that provided by the disk, and the container may therefore offer the facility of providing an increased reminder capability compared to similar prior art containers.

Many individuals encounter difficulty in remembering whether medication has or has not been taken at a prescribed time which may result in medication being omitted or two doses being taken, either of which can be detrimental to the health and well being of the individual. Accordingly, the present invention provides an arrangement by which a user is antomatically reminded as to when the next dose of medication is to be taken.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a pharmaceutical container having an indicating closure attached thereto.

FIG. 2 is an exploded perspective view showing various components of the container and closure.

FIG. 3 is a sectional view, on an enlarged scale, taken on line 3—3 of FIG. 1.

DESCRIPTION OF THE PREFERRED EMBODIMENT

Referring initially to FIG. 1 of the drawings, there is illustrated a pharmaceutical container 10 having an attached closure in the form of a twist-on, twist-off cap 12, which includes indicating means which is indexed automatically, as will be described, into succeeding indicator positions, each time the container is used by removal and replacement of the cap. The container further includes a reminder device 14 at the base of the container for indicating to a user the time of day that, for example, medication is to be taken. The various components of the container and closure may, for example, be made of conventional lightweight plastic or like materials. In order to remove cap 12 from the container so as to obtain access to the container contents, the cap is depressed and twisted in counterclockwise direction, as will be described. Replacement of the cap is effected by depression and reverse twisting.

Cap 12 comprises a body member 16 having a base 18 and a depending skirt 20. A window opening 22 is formed in the base, through which opening is visible a portion of the top surface of an indicator disk 24 (see FIGS. 2 and 3). The top surface of the disk carries a series of indicator marks 26 spaced at equal angles around the disk, so that at any time only one such mark is visible in window opening 22. In the illustrated embodiment, there are seven indicator marks each denoting a different day of the week. It will be understood, however, that the number and function of the marks may differ dependent on the application of the invention. For example, the marks may comprise a series of numbers to indicate the number of times the container has been opened. The construction of the apparatus is such that each time the container is used, by removing and replacing cap 12, disk 24 is rotated by one indexing increment, so as to bring a succeeding indicator mark into view in window opening 22. In the illustrated embodiment, each increment comprises an angle of about 51.4°, i.e. 1/7 of a complete circle. The construction of the container and closure which provides the above operation will now be described in greater detail with particular reference to FIGS. 2 and 3.

Disk 24 is rotatably journalled in the interior of cap body member 16 in juxtaposition to base 18 on a central carrying pin 28. A spring washer 30, or the like, may be interposed between the base and the disk resiliently urging these members apart. Circumferentially spaced locking projections 32 are formed on the interior of skirt 30, and these cooperate, in known manner, with complementary channel-like shaped locking projections 34 on the exterior of container 10. Projections 34 each have a shorter leg 33 and a longer leg 35, so that in order to replace and secure cap 12, it is necessary to twist and depress the cap bringing the projections 32 under the shorter legs of respective projections 34 and into the receiving pockets between the legs. Removal of the cap requires depression thereof causing projections 32 to clear the shorter channel legs prior to reverse twisting of the cap.

Indexing means comprising cooperative sets of ratchet teeth on disk 24, on body member 16, and on container 10, is provided for effecting the required indexing movement of the disk each time the cap is removed and replaced. A first cooperative set of ratchet teeth comprise teeth 36 formed on the upper surface of disk 34 and complementary teeth 38 formed on the inner surface of cap base 18. The direction and disposition of teeth 36 and 38 are such as to permit rotation of body member 16 relative to disk 24 in a counterclockwise direction of rotation of the cap, but to inhibit relative rotation of the disk and body member when the cap is rotated in the opposite direction. A second cooperative set of ratchet teeth comprises teeth 40 on the bottom of disk 24 and complementary teeth 42 defining a flanged rim of container 10. The direction and disposition of teeth 40 and 42 is such as to allow counterclockwise rotation of disk 24 relative to the container, but to hold the disk against clockwise rotation relative to the container. In the illustrated embodiment, there are seven equally circumferentially spaced cooperative teeth in each set, but this number can be varied.

With the above arrangement of ratchet teeth, when cap 12 is twisted in counterclockwise direction on container 10, in order to remove the cap, no relative movement takes place between body member 16 and disk 24 which rotate together, so that there is no change in the indexing mark visible through window 22. When the cap is replaced on the container, however, and twisted in clockwise direction, teeth 40 and 42 hold the disk 24 against rotation, so that only body member 16 rotates, thereby moving window opening 22 relative to the indicator marks 26. Further, it is necessary to insure that the twisting movement of body member 16 relative to disk 24 is through the proper angle (i.e. about 51.4°) to bring a succeeding indicator mark 26 into view in opening 22. This is accomplished, in accordance with the invention, by positioning projections 32 relative to the ratchet teeth such that when replacing the cap on the container with teeth 40 and 42 in engaging position for preventing rotation of disk 24, the projections 32 are spaced the required 51.4° away from their locking positions in projections 34. Preferably, in order to insure this dispositioning of the projections when the cap is replaced, teeth 40 and 42 may be suitably shaped to promote replacement of the cap in the required position.

Indicator device 14 at the base of container 10 comprises a wheel 50 mounted for rotation on a pin 52 depending from base wall 54 of the container, the wheel having an arrow 56 adapted to cooperate with a numbered ring 58 on the container. Complementary ratchet teeth 60 and 62 may be formed on the container and the wheel respectively conforming in number to the numbers on ring 58. This arrangement allows arrow 56 to be indexed from number to number, for example, to indicate the hour on which a pharmaceutical is to be taken from the container.

It is evident from the above description that the invention provides an indicating container and closure of simple construction which indexes automatically when the container is used. By utilizing the complementary sets of ratchet teeth in combination with the locking projections in order to set the correct amount of indexing movement of the indicator disk, no additional means is required for this purpose.

Additionally, the combination of the container with an automatically indexing indicator means in the cap, and a further indexible reminder device on the base, provides a combined indicating facility which is not available in known containers.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A container having an indicating closure in the form of a cap comprising a body member with a base and a depending circumferential skirt, and an indicator disk associated with the body member for incremental rotational movements relative to the body member into different indicating positions, complementary circumferentially spaced locking formations on the skirt and on the container respectively for releasably securing the cap on the container by a non-threaded twist lock action, indexing means on the body member, on the disk, and on the container respectively for effecting rotational movement of the disk relative to the body member when the cap is twisted on the container in one direction and for restraining the disk to move with the body member when the cap is twisted on the container in the other direction, and means for relating the positioning of the locking formations on the skirt to the positioning of the locking formations on the container for relative rotational movements thereof between a cap-release position and a cap-locking position through an angle corresponding to an incremental rotational movement of the disk thereby providing the required incremental rotation of the disk whenever the cap is removed and replaced.

2. A container as defined in claim 1 wherein the indexing means comprises a first set of complementary interengaging ratchet teeth on said body member and on said disk respectively, and a second set of engageable ratchet teeth on said disk and on the container, respectively.

3. A container as defined in claim 2 wherein the second set of ratchet teeth have interengaging surfaces defining the means for relating the positioning of the locking formations on the skirt to the positioning of the locking formations on the container.

4. A container as defined in claim 2 wherein the container has a rim defining ratchet teeth of said second set.

5. A container as defined in claim 1 wherein the disk is journalled internally within said body member in juxtaposition to the base, wherein the base has a window opening, and wherein the disk is provided with indicator marks successively visible in said opening in successive indicating positions of the disk.

6. A container as defined in claim 1 wherein said locking formations comprise locking projections on the interior of the skirt and complementary locking projections on the exterior of the container spaced at a sufficient angle therebetween to accommodate movement of the locking projections on the skirt through an angle corresponding to the incremental rotational movement of the disk.

7. A container is defined in claim 6 wherein the locking projections on the container are channel-shaped, each having a longer leg and a shorter leg with a pocket therebetween for receiving a locking projection on the skirt.

8. A container as defined in claim 1 and which further includes a movable reminder device at the base of the container which may be manually indexed into different reminder positions.

9. A container as defined in claim 8 wherein the reminder device comprises a wheel journalled on the base of the container and complementary ratchet teeth on the wheel and the container permitting the wheel to be indexed to different indicating positions.

10. A container as defined in claim 9 wherein the base of the container carries a circumferential series of indicator markings and the wheel has an indicator adapted to align with the respective ones of said markings in respective indicating positions of the rotary member.

11. A container as defined in claim 8 wherein the disk is adapted to indicate different days of the week and the remainder device is adapted to indicate different hours of the day.

12. A container having a twist-on, twist-off closure cap, the cap comprising a body member having a base and a depending skirt, circumferentially spaced complementary locking formations on the interior of the skirt and on the exterior of the container for providing twist lock action of the cap on the container between cap locking and cap release positions, an indicator disk journalled internally of the body member for incremental rotary movements relative to the body member into successive indicator positions, and indexing means for automatically moving the disk incrementally from one indicating position to the next each time the container is used by removal and replacement of the cap, the indexing means comprising a first set of complementary ratchet teeth on the interior of the body member and on the disk respectively, and circumferentially disposed ratchet teeth on the disk to engage with complementary ratchet teeth on the rim of the container to form a second set of teeth, the first set of ratchet teeth permitting relative rotation between the body member and the disk when the cap is twisted in one direction on the container but causing the disk to move with the body member when the cap is twisted in the other direction on the container, the second set of ratchet teeth permitting relative rotation of the disk and the container when the cap is twisted in said other direction but restraining the disk against movement relative to the container when the cap is twisted in said one direction, and means providing angular movements of said locking formations between the cap release and cap locking position substantially conforming to the angle of incremental disk rotation between successive indexing positions so as to provide the required disk rotation whenever the cap is removed and replaced.

13. A container as defined in claim 12 wherein the disk has circumferentially spaced indicator marks and the base of said body member has a window opening through which said marks are successively visible in successive indexing positions of the disk.

14. A container as defined in claim 13 wherein the disk has seven equally spaced indicator marks denoting respective days of the week and wherein the angle of movement between the cap release and cap locking positions is such as to provide about 51.4° of rotation of the disk each time the container is used by removing and replacing the cap, so as to bring successive markings into view in said window opening.

15. A container as defined in claim 13 wherein the ratchet teeth in each set are seven in number, and the indicator marks on the disk denotes successive days of the week.

16. A container as defined in claim 12 which further includes a manually movable reminder device on the base of the container indexible into successive indicating positions with respect to the container.

17. A container as defined in claim 16 wherein the reminder device comprises a wheel journalled on the base of the container and complementary ratchet teeth on the wheel and on the container for indexing the wheel into different indicating positions.

18. A container as defined in claim 16 wherein the disk is adapted to indicate days of the week and the reminder device is adapted to indicate hours of the days.

* * * * *